US010370141B2

(12) United States Patent
Prakken

(10) Patent No.: US 10,370,141 B2
(45) Date of Patent: Aug. 6, 2019

(54) PACKING BOX

(71) Applicant: BLUEPRINT HOLDING B.V., Woerden (NL)

(72) Inventor: Nicolaas Martin Prakken, Chester, VA (US)

(73) Assignee: BLUEPRINT HOLDING B.V, Woerden (NL)

( * ) Notice: Subject to any disclaimer, the term of this patent is extended or adjusted under 35 U.S.C. 154(b) by 0 days.

(21) Appl. No.: 15/761,922

(22) PCT Filed: Sep. 22, 2016

(86) PCT No.: PCT/NL2016/050657

§ 371 (c)(1),
(2) Date: Mar. 21, 2018

(87) PCT Pub. No.: WO2017/052374

PCT Pub. Date: Mar. 30, 2017

(65) Prior Publication Data

US 2018/0282016 A1 Oct. 4, 2018

(30) Foreign Application Priority Data

Sep. 22, 2015 (NL) ..... 2015480

(51) Int. Cl.
*B65D 5/54* (2006.01)
*B65D 5/02* (2006.01)
(Continued)

(52) U.S. Cl.
CPC ..... *B65D 5/5445* (2013.01); *B65D 5/0227* (2013.01); *B65D 5/4608* (2013.01); *B65D 5/16* (2013.01); *B65D 5/2057* (2013.01)

(58) Field of Classification Search
CPC ..... B65D 5/5445; B65D 5/0227; B65D 5/16; B65D 5/4608; B65D 5/2057; B65D 5/54; B65D 5/02; B65D 2571/00728
(Continued)

(56) References Cited

U.S. PATENT DOCUMENTS 4,113,100 A * 9/1978 Soja ..... B65D 5/5445 229/112
4,905,837 A * 3/1990 Schuster ..... B65D 5/5475 229/120.011
(Continued)

FOREIGN PATENT DOCUMENTS

FR 2748726 A1 11/1997

OTHER PUBLICATIONS

International Search Report, dated Nov. 21, 2016, from corresponding PCT application No. PCT/NL2016/050657.

*Primary Examiner* — Corey N Skurdal
(74) *Attorney, Agent, or Firm* — Young & Thompson

(57) ABSTRACT

A packing box includes opposing first/second and opposing third/fourth side panels, each having opposing first/second flank sides and opposing first/second end sides. A flank side connects to a flank side of an adjacent side panel, defining the circumference. The first end sides at a first end of the box have first flaps closing the first end, and the second end sides at a second end of the packing box have second flaps closing the second end. The first flap of the third side panel has opposing sides associated with the first and second side panels, which can be attached to the first and second side panels such that the first flap of the third side panel partly closes the first end. Tear lines in the first and second side panels allow removing at least part of the first, second and fourth side panels so as to leave a display case.

20 Claims, 11 Drawing Sheets

(51) Int. Cl.
*B65D 5/468* (2006.01)
*B65D 5/16* (2006.01)
*B65D 5/20* (2006.01)

(58) Field of Classification Search
USPC ..... 229/235, 242, 925
See application file for complete search history.

(56) References Cited

U.S. PATENT DOCUMENTS

| | | | | |
|---|---|---|---|---|
| 5,167,324 | A * | 12/1992 | Miller | B65D 5/48014 206/738 |
| 5,582,345 | A * | 12/1996 | Lankhuijzen | B65D 5/5445 229/235 |
| 6,402,021 | B1 | 6/2002 | Heathcock | |
| 8,910,856 | B2 * | 12/2014 | Sumpmann | B65B 69/0033 206/746 |
| 9,994,356 | B2 * | 6/2018 | Couture | B31B 50/48 |
| 10,131,462 | B2 * | 11/2018 | Capistrant | B65D 5/5445 |
| 2004/0222127 | A1 * | 11/2004 | McLeod | B65D 5/4204 206/736 |
| 2006/0043161 | A1 | 3/2006 | Provus et al. | |
| 2015/0053587 | A1 | 2/2015 | Gessler, Jr. et al. | |

* cited by examiner

PACKING BOX

FIELD OF THE INVENTION

The invention relates to a packing box for holding articles.

BACKGROUND OF THE INVENTION

Packing boxes are widely applied for holding, storing and transporting articles. The articles are produced at a manufacturing site, where they generally are packed into the packing box in dedicated packing lines. Subsequently they are usually shipped to a location where the articles will be distributed. In between packing and shipping, and in between shipping and distribution the packing boxes with articles may be stored and/or change from transportation means to another. The packing boxes should therefore be well suited for packing, transportation and handling. So-called Regular Slotted Case (RSC) packing boxes are widely available that are very well suited for this purpose and that are widely used. These boxes have circumferential side panels and flaps at both ends of each side panel, which can be folded in for closing the packing box at both ends. A large number of filling stations are available for packing products or articles in such RSC packing boxes.

It has become customary to display the packing box or part of the packing box with articles in, for instance, a super market. Customers can take the articles directly from the packing box. Packing boxes have been proposed specifically for this purpose. However, they usually appear quite damaged when put up for display with the products. Especially the viewing side of a display part of such packing boxes does not present a clean viewing side when put up for display.

Further, packing boxes that are designed to allow to put up products for display in the packing box are not well suited for packing, storing and transportation of products or articles in the packing box. Such packing boxes prove not to be suited for handling in the filling stations of RSC type packing boxes, and require dedicated and costly machinery for forming and filling them with articles. Packing boxes designed to allow to put up articles (products) up for display are mostly assembled out of two parts requiring two forming machines. Therefore, there is a need for an improved packing box that can also be very well used for displaying products.

FR 2 748 726 A1 discloses a packing box having side panels determining a circumference and opposing ends of the packing box and having flaps configured for closing both ends. However, the packing box disclosed does not present tear lines and is not configured for removing a part of the packing box to present a display part. Even if one would add tear lines, one would not obtain a display part of the packing box that presents a clean viewing side and that would allow an efficient separation of parts of the box to provide a display part.

U.S. Pat. No. 6,402,021 B1 discloses a packing box having tear lines allowing to remove a part of the box so as to leave a display part. The tear lines are arranged such that they clearly show during display, so that the display part does not present a clean display face. The tear lines, for instance, pass over the front or viewing side of the packing box, which would result in a damaged presentation of a display part of the box.

SUMMARY OF THE INVENTION

It is an objective of the invention to provide a packing box that allows to put up articles for display in a part of the packing box.

It is another or alternative objective of the invention to provide a packing box that can efficiently be packed with articles.

It is yet another or alternative objective of the invention to provide a packing box that can be handled in filling stations for RSC type packing boxes with minimum or no modification.

It is yet another or alternative objective of the invention to provide a packing box that can be formed and filled by a single and commonly available forming and filling machine.

It is yet another or alternative objective of the invention to provide a packing box that is very well suited for storing and transporting articles.

It is yet another or alternative objective of the invention to provide a packing box that is well suited for stacking of multiple packing boxes.

It is yet another or alternative objective to provide a packing box that allows to put up articles for display in a part of the packing box and that presents at least a clean viewing side of a display part of the packing box.

At least one of the above objectives is achieved by packing box for holding articles, the packing box comprising opposing first and second side panels and opposing third and fourth side panels, each side panel having opposing first and second flank sides and opposing first and second end sides, a flank side of one side panel being connected to a flank side of an adjacent side panel so as to determine a circumference of the packing box, the first and second side panels each with their first flank side being connected to a respective flank side of the third side panel, and the first and second side panels each with their second flank side being connected to a respective flank side of the fourth side panel, the first end sides of the first, second, third and fourth side panels corresponding to a first end of the packing box and comprising first flaps that are configured for closing the first end of the packing box, and the second end sides of the first, second, third and fourth side panels corresponding to a second end of the packing box and comprising second flaps that are configured for closing the second end of the packing box, wherein the first flap of the third side panel has opposing sides associated with the first and second side panels, which opposing sides are or can be attached to the first and second side panels such that the first flap of the third side panel partly closes the first end of the packing box, and wherein tear lines are provided in at least the first and second side panels so as to allow removing a part of the first and second side panels and at least part of the fourth side panel together with the first flaps of the first, second and fourth side panels so as to leave a display case part (1*a*) of the packing box.

The design of such packing boxes basically follows the design of RSC type packing boxes and can therefore be handled well on filling stations suited for packing RSC type boxes. The packing box according to the invention further provides the functionality of turning the packing box for storing and transport purposes into a display case by removing part of the packing box. The packing box is filled and transported on its second end. For display it is put on its third side panel, and a top part can be removed. The first end with the first flap of the third side panel provides a very clean display side of the display case. The edge side of the first side flap of the third side panel, which is the top side of the front of the display case part, has not been part of a tear line and presents therefore a very clean appearance. The side panels need not all have a first or second flap at their first and second end sides. However, sufficient first and/or second flaps should be available to allow closing the first and second ends of the packing box. Score lines are generally provided at the connection of the side panels and at the connection of a flap with a side panel. The score lines assist in providing in folding the packing box from a corresponding blank and in folding the flaps, and to provide neat folds. The score lines of flaps at the first and/or second ends need not be provided in line.

In an embodiment the display case part comprises the third side panel, the first flap of the third side panel, parts of the first and second side panels connected to the third side panel, and at least parts of the second flaps connecting third side panel and the parts of the first and second side panels connected to the third side panel.

In an embodiment the tear lines in the first and second side panels have an end at the respective first end side of the first and second side panels. This provides for removal of part of the first end side of the first and second side panels, which are sides of the display case on top of its bottom, for a better display of the articles or products in the display case.

In an embodiment the first flap of the third side panel has a flap height as measured from the first end side of the third side panel to an opposing edge side of that first flap, and wherein the end of the tear lines at the respective first end sides of the first and second side panels is at a distance from the respective first flank sides of the first and second side panels, which distance substantially corresponds to the flap height, optionally is equal to the flap height. The flap height corresponds to the height of the display case at its front or display side and also the sides of the display box are at approximately this height for a convenient and good display of the articles in the display case.

In an embodiment the tear lines in the first and second side panels extend to respective second end sides of the first and second side panels, especially do not pass or extend to and/or along a flank side. By extending to the second end sides and not crossing or extending along flank sides. The flank sides are not weakened by the tear lines. The tear lines present a weakened part to allow dividing the packing box along the tear lines. The flank sides should keep their strength since multiple packing boxes may be stacked on top of one another, so the flank sides will bear weight. By having the tear lines extend to the second end sides the flank sides are allowed to keep their strength.

In an embodiment the tear lines in the first and second side panels extend into respective second flaps of the first and second side panels such that these second flaps each are divided into two parts associated with the third and fourth side panels. Having the tear line extend in these second flaps allows easy tearing of the packing box at its back side for efficient removal of its top part with respect to the display case.

In an embodiment, in a configuration wherein the second flaps close the second end of the packing box, the second flap of the third side panel is only attached to the parts of the second flaps of the first and second side panel, which are associated with the third side panel, and the second flap of the fourth side panel is only attached to the parts of the second flaps of the first and second side panel, which are associated with the fourth side panel, the respective second flaps especially being attached by a glue. Then only the second flaps of the first and second side panels require tearing to separate the top part. No additional tearing of the second flaps of the third and fourth side panels is required.

In an embodiment, in a configuration wherein the second flaps close the second end of the packing box, the second flaps of the third and fourth side panel do not overlap, and the tear lines in the second flaps of the first and second side panels are intermediate of the second flaps of the third and fourth side panels. Such embodiment is especially convenient to prevent the second flaps of the third and fourth side panel to be attached to the parts of the second flaps of the first and second side panels associated with the fourth and third side panel, respectively.

In an embodiment the second flaps of the first and second side panels comprise cutouts in their respective sides opposing the second side of the respective first and second side panels, and a second end of the tear lines is provided at the respective cutouts, which cutouts provide a handle opening in the second end of the packing box in a configuration wherein the second flaps close the second end of the packing box. Having a handle opening provides easy grip on the packing box for removal of the top part from the display case part.

In an embodiment the second flaps of the third and fourth side panel are configured such that they do not overlap with the handle opening in a configuration wherein the second flaps close the second end of the packing box. This prevents that the handle opening becomes obstructed by these second flaps of the third and fourth side panels.

In an embodiment the first flap of the third side panel has a side skirt at each of its opposing sides associated with the first and second side panels, the side skirts being configured to allow attaching of the side skirts to the respective first and second side panels such that the flap at the first end side of the third side panel partly closes the first end of the packing box, especially the side skirts of the first flap of the third side panel being attached to the respective first and second side panels by a glue. These side skirts can be efficiently made in the black and also be attached to the first and second side panels to provide an upstanding face of the display case and to partly close the packing box after packing. Such configuration can also be handled in existing RSC type packing box filling lines with no or only minor modification. Side skirts as referred to in this description are intended for attachment, for instance, by gluing, to another part of the packing box (or its corresponding blank).

In an embodiment wherein the first flaps of the first and second side panels are only connected to the first and second side panels, respectively, between the respective tear line and the respective second flank side of the first and second panels to allow an straightforward and clean removal of part of the packing box to provide a clean display case.

In an embodiment the first flaps of the first and second side panels have a flap width as measured along the respective first end sides of the first and second side panels, which flap width is equal to or smaller than a distance along the respective first end sides of the first and second side panels between the respective second flank sides and the end of the respective tear lines at the first end sides of the first and second side panels, and wherein the first flaps of the first and second side panels are connected to the respective first end sides between the respective second flank sides and the end of the respective tear lines at the first end sides of the first and second side panels. This provides that these first flaps do not obstruct tearing of the tear line in the first and second side panels.

In an embodiment the flap width of the first flaps of the first and second side panels is such that these first flaps and the first flap of the third side panel do not overlap in a configuration wherein the first flaps close the first end of the packing box to allow for a front side at the second end of the packing box in one plane.

In another aspect the invention provides for a blank for providing a packing box according to any one of the preceding claims, wherein the blank comprises first, second, third and fourth side panels, each side panel having opposing first and second flank sides and opposing first and second end sides, a flank side of one side panel being connected to a flank side of an adjacent side panel, the first and second side panels each with their first flank side being connected to a respective flank side of the third side panel, the fourth side panel with one of its first and second flank sides being connected to a flank side of one of the first and second side panels, which flank side of the one of the first and second side panels is not connected to the third side panel, the first end sides of the first, second, third and fourth side panels corresponding to a first end of the blank and corresponding packing box and comprising first flaps that are configured for closing the first end of the packing box, when assembled, and the second end sides of the first, second, third and fourth side panels corresponding to a second end of the blank and corresponding packing box and comprising second flaps that are configured for closing the second end of the packing box, when assembled, wherein the first flap of the third side panel has opposing sides associated with the first and second side panels, which opposing sides can be attached to the first and second side panels such that the first flap of the third side panel partly closes the first end of the packing box, when assembled, and wherein tear lines are provided in at least the first and second side panels so as to allow removing a part of the first and second side panels and at least part of the fourth side panel together with the first flaps of the first, second and fourth side panels.

In an embodiment the other one of the first and second flank sides of the fourth side panel comprises a side skirt configured for attachment to a flank side of the other one of the first and second side panels, which flank side of the other one of the first and second side panels is not connected to the third side panel.

In an embodiment the blank is made from a single piece of material.

Further embodiments of the blank correspond to the embodiments of the packing box as referred to above.

BRIEF DESCRIPTION OF THE DRAWINGS

Further features and advantages of the invention will become apparent from the description of the invention by way of non-limiting and non-exclusive embodiments. These embodiments are not to be construed as limiting the scope of protection. The person skilled in the art will realize that other alternatives and equivalent embodiments of the invention can be conceived and reduced to practice without departing from the scope of the present invention. Embodiments of the invention will be described with reference to the accompanying drawings, in which like or same reference symbols denote like, same or corresponding parts, and in which.

DETAILED DESCRIPTION OF EMBODIMENTS

Figure 3:
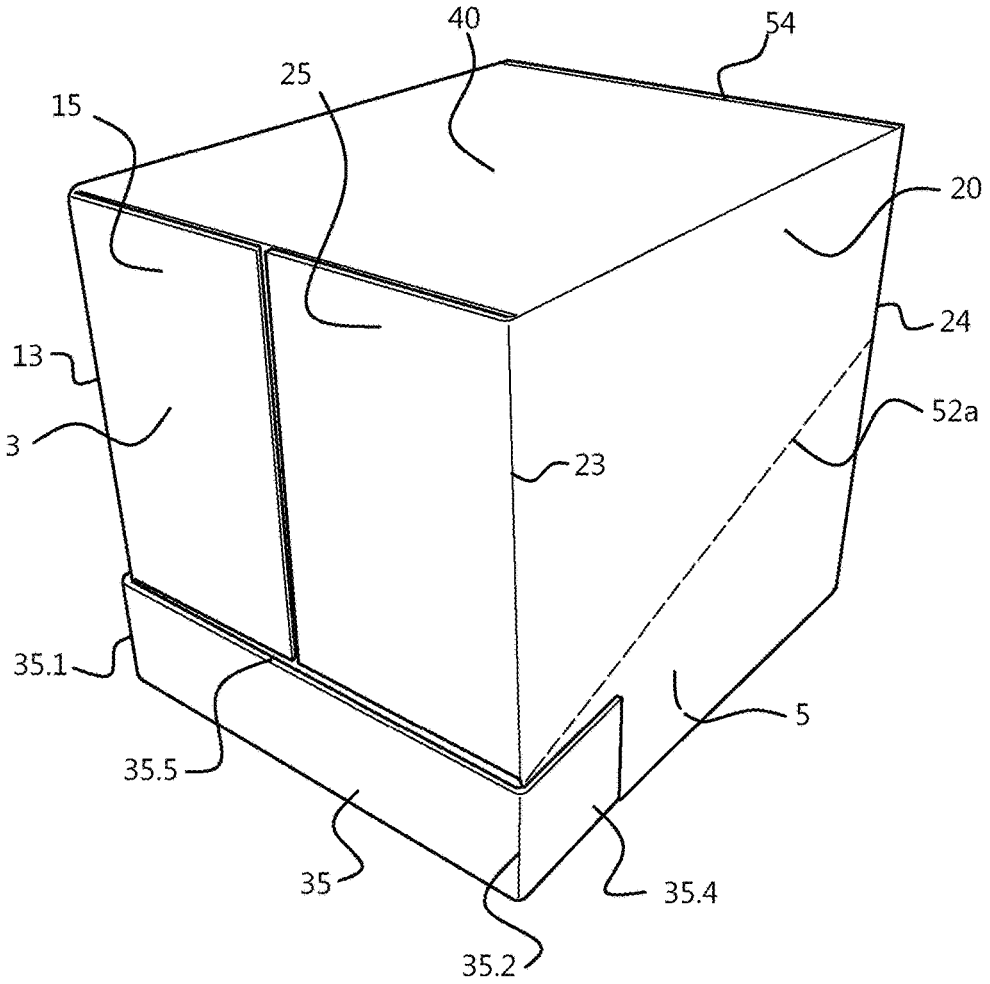
FIG. 3 shows the embodiment of FIG. 1 on its bottom side from the front side with closed front side.
Figure 4:
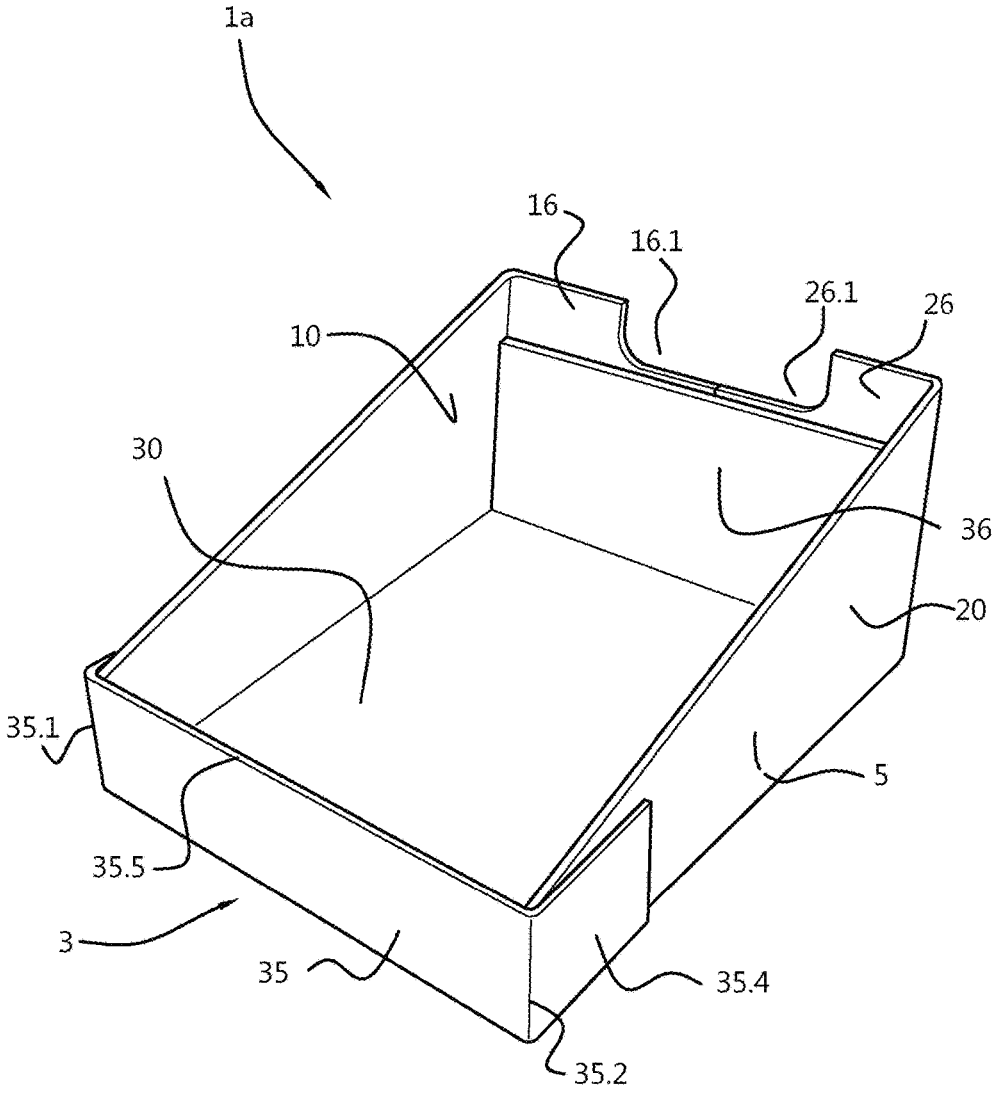
FIG. 4 shows a display part of the packing box of FIG. 1 in the position of FIG. 3, the top part of the packing box being removed.
Figure 5:
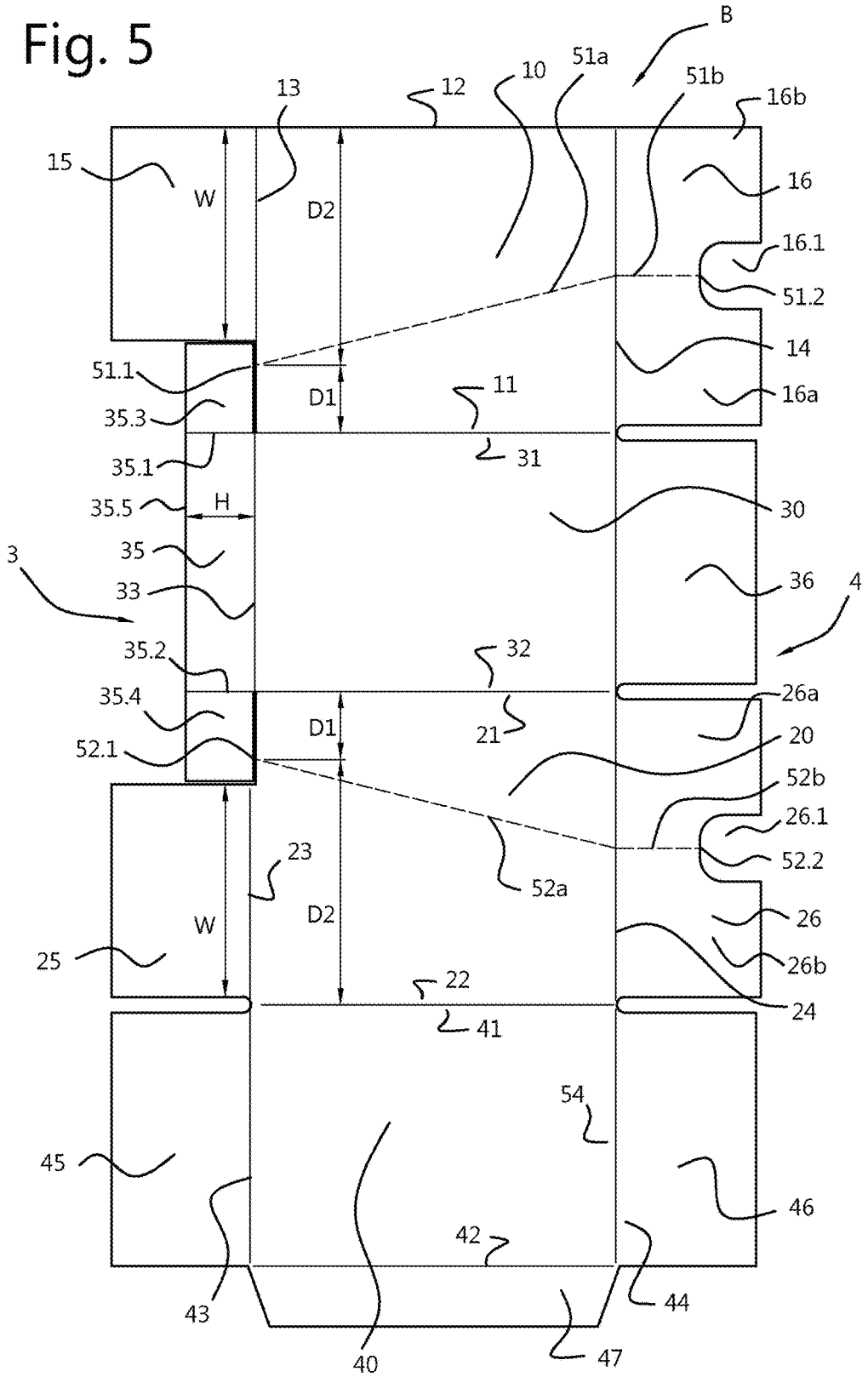
FIG. 5 shows a blank from which the packing box of FIGS. 1-4 can be assembled.

An embodiment of a packing box 1 according to the invention is shown in FIGS. 1 to 4. A blank B from which the packing box 1 has been assembled is shown in FIG. 5. The box 1 has opposing first and second side panels 10, 20 and opposing third and fourth side panels 30, 40. The first side flanks 11, 21 of the first and second side panels 10, 20 are connected to the first and second flank sides 31, 32, respectively, of the third side panel 30. The second flank sides 12, 22 of the second and first side panels 10, 20 are connected to the first and second flank sides 41, 42, respectively, of the fourth side panel 40. The blank B is, in the embodiment shown, made of a single piece of corrugated cardboard, in which all the flank sides connections are provided by the single piece of material, apart from the connection in the packing box between the second side flank 12 of the first side panel 10 and the second side flank 42 of the fourth side panel 40. The fourth side panel has a side skirt 47 connected to its second side flank 42. Side skirt 47 has been attached by a glue to the inside of the first side panel 10 when assembling the packing box to connect the second flank side 42 of the fourth side panel 40 and the second flank side 12 of the first side panel. After assembling the side panels 10, 20, 30, 40 determine a circumference of the packing box 1.

The first, second, third and fourth side panels have first end sides 13, 23, 33, 43 corresponding to a first end 3 of the packing box 1 and second end sides 14, 24, 34, 44 corresponding to second end 4 of the packing box. Second flaps 16, 26, 36, 46 are connected to the second end sides of the side panels. The second flaps have been folded inwards and attached together to close the second end 4 of the packing box in the embodiment shown. The second flaps 36 and 46 have been folded in first after which the second flaps 16 and 26 are folded in and glued on top of the second flaps 36 and 46, as is especially shown in FIG. 2. Other manners may be used as well to close the second end of the packing box with the second flaps. The closed second end of the packing box is referred to as the back side 4 in this description.

Figure 1:
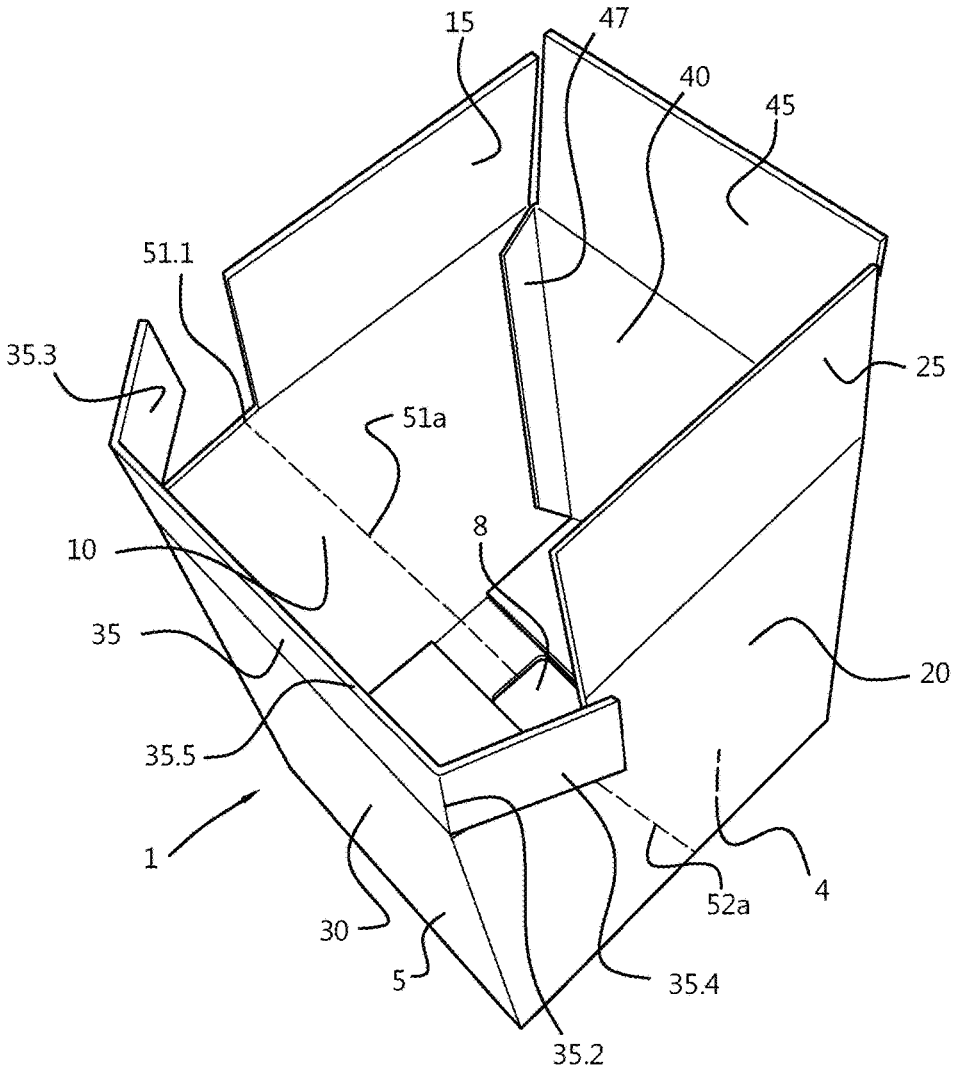
FIG. 1 shows a first embodiment of a packing box of the invention on its backs side with an open front side turned upwards.

FIG. 1 shows the packing box on its closed back side (second end) 4. The front side (first end) 3 is still open and can be filled with articles A (shown in FIG. 6). The articles can be filled into the backing box in the position of FIG. 1 with their back sides downwards, their front or viewing sides upwards, and their bottom sides towards the third side panel 30. The side of the packing box corresponding to the third side panel 30 is referred to as the bottom side 5 of the packing box 1 in this description. The packing boxes will generally be filled on a packing line and transported on the packing line with the side panel with the shortest width facing the transporting direction, which corresponds to the third side panel 30 (or fourth side panel 40) in the embodiment shown.

When the packing box has been filled with articles, it is closed by closing the first flaps 15, 25, 35, 45 connected to the first end sides 13, 23, 33, 43 of the first, second, third and fourth side panels 10, 20, 30, 40. The first flap 35 connected at the first end 33 of the third side panel 30 has side skirts 35.3, 35.4 at opposing ends 35.1, 35.2 of the first flap 35, which opposing ends 35.1, 35.2 are associated with the first and second side panels 10, 20, respectively. Associated means that the first side skirt 25.3 is at the same side of the first flap 35 as the first side panel, and that the second side skirt 25.4 is at the same side of the first flap 35 as the second side panel. The first flap 35 is folded in and the side skirts 35.1, 35.2 are attached by a glue on the outside surfaces of the first and second side panels. First flap 35 partly closes the front side of the packing box. The first flap 45 connected at the first end 43 of the fourth side panel 40 is folded in and subsequently the first flaps 15, 25 connected at the first sides 13, 23 of the first and second side panels 10, 20 are folded in and attached by a glue on top of the first flap 45 of the fourth side panel 40. The first flaps 15, 25, 35, 45 thus close the front side (first end) 3 of the packing box. FIG. 3 shows the closed front side (first end) 3 of the packing box. In FIG. 3 the packing box is placed on its bottom side 5. The first flaps 15, 25 at the first sides of the first and second side panels 10, 20 on the one hand and the first flap 35 on the other hand do not overlap so as to form a front side in one plane x.

Alternatively, the first flap 35 at the first end 33 of the third side panel 30 may not have side skirts 35.3, 35.4. In such configuration, side skirts (not shown) can be provided to the first ends of the first and second side panels. Such side skirts are connected to the first sides 13, 23 of the first and second side panels next to the first flaps 13, 23 and near the first flank sides 11, 21 of the first and second side panels. These side skirts can be folded in and the first flap 35 connected to the first end side of the third side panel attached by a glue on top of these alternative side skirts.

Tear lines 51*a*, 52*a* are provided in the first and second side panels 10, 20. The tear lines 51*a*, 52*b* in the first and second side panels have first ends 51.1, 52.1 at the first end sides 13, 23 thereof at a distance D1 from the first flank sides 11, 21 that substantially corresponds to a flap height H of the first flap 35 at the first end side 33 of the third side panel 30. The flap height H of the first flap 35 is measured from the first end side 33 of the third side panel 30 to the opposing side of the first flap 35. In the embodiment shown the flap height H is almost equal to but slightly larger than the distance D1. The tear lines 51*a*, 52*a* in the first and second side panels 10, 20 extend tot the second end sides 14, 24 thereof and subsequently extend further into tear lines 51*b*, 52*b* in the second flaps of the first and second side panels, respectively.

The tear lines 51*b*, 52*b* divide the second flaps 16, 26 each in two parts 16*a*, 26*a*; 16*b*, 26*b* that are associated with the third and fourth side panels 30, 40, respectively, and are perpendicular to the first end sides 14, 24 of the first and second sides. Cutouts 16.1, 26.1 are provided at the end of the tear lines 51*b*, 52*b* in the sides of the second flaps 16, 26 opposing the second end sides 14, 24 of the first and second side panels 10, 20. In the closed configuration of the second flaps 16, 26 the cutouts 16.1, 26.1 make up a handle opening 8. In the closed configuration of the second flaps and thus second end of the packing box, the parts 16*a*, 26*a* of the second flaps 16, 26 associated with the third side panel are attached by a glue to the second flap 36 of the third side panel. The second flaps 16*b*, 26*b* associated with the fourth side panel 40 are attached by a glue to the second flap 46 of the fourth side panel 40. The second flaps 36, 46 of the third and fourth side panel are configured such, that is their flap heights as measured from the second ends 14, 24, is such that they do not overlap in the closed configuration, and also do not overlap with the cutouts 16.1, 26.1 and handle opening 8. The tear lines 51*b*, 52*b* in the second flaps 16, 26 of the first and second side panels are located such that they are intermediate of the second flaps 36, 46 of the third and fourth side panels.

The first flaps 15, 25 connected at the first end sides 13, 23 of the first and second side panels 10, 20 have a flap width W, as measured along these first end sides. These first flaps 15, 25 are connected to the first end sides 13, 23 of the first and second side panels 10, 20 between the second flank sides 12, 22 thereof and the first end 51.1, 52.1 of the tear lines 51*a*, 52*a* at these first end sides 13, 23. The flap width W of these first flaps is smaller than a distance D2 between these second flank sides 12, 22 and the respective first ends 51.1, 52.1 of the tear lines 51*a*, 52*a* at these first end sides 13, 23. The sum of a flap width W of the first flaps 15, 25 and the flap height H of the first flap 35 is smaller than the width of the first and second side panels 10, 20 between their first and second flank sides as measured along their first end sides 13, 23. The flap width W and the flap height H are therefore such that the first flap 35 on the one hand and the first flaps 15, 25 on the other hand do not overlap when they close the front side 3 of the packing box as is visible in FIG. 3. FIG. 3 shows a small gap between the first flaps 15, 15 connected to the first and second side panels and the first flap 35 connected to the third side panel.

Figure 6:
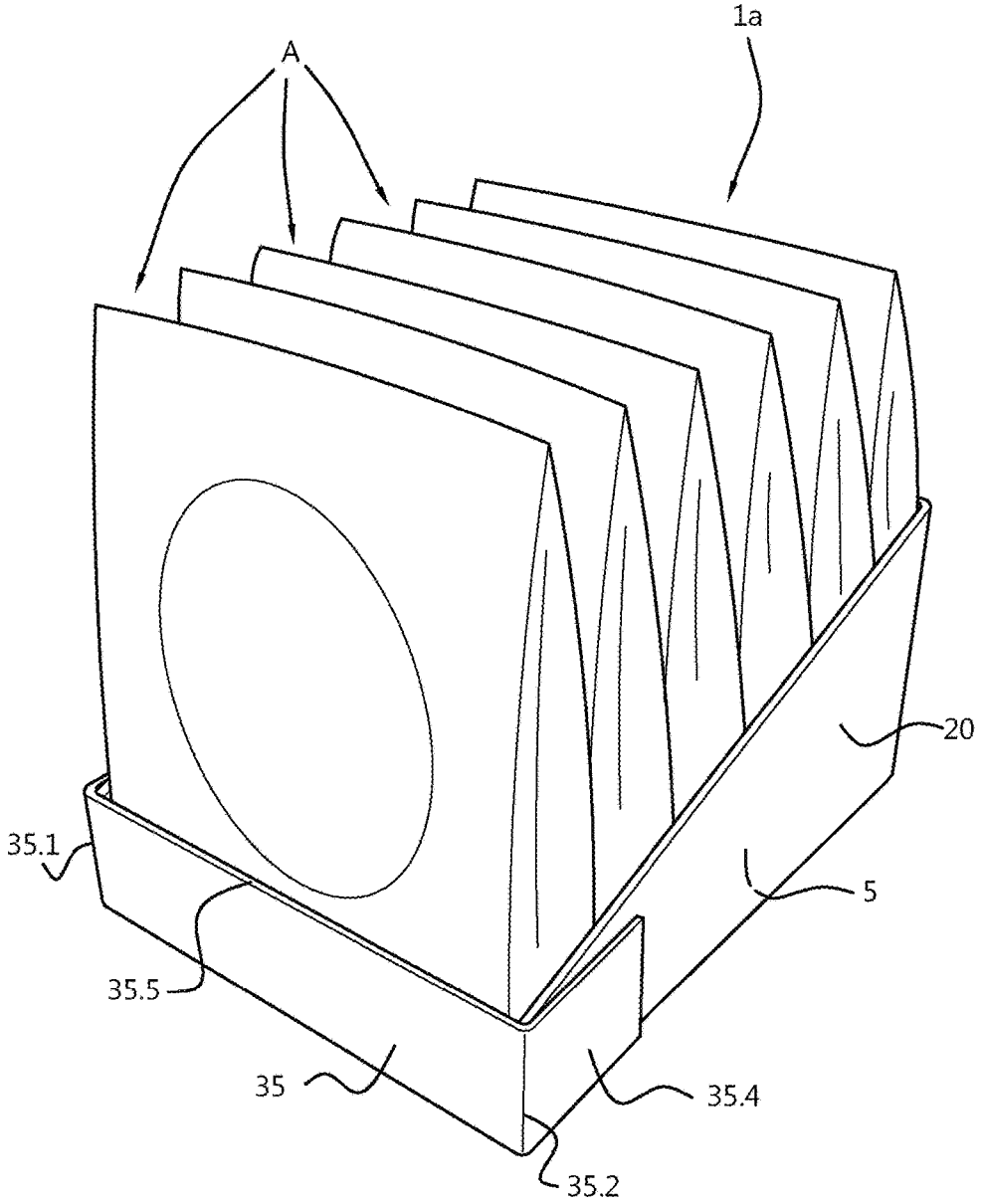
FIG. 6 is the same as FIG. 4 but with the display case part of the packing box filled with products.

With reference to FIG. 1 it has been described to provide the articles in the packing box with their viewing sides towards the front side 3 of the packing box when the packing box is at its back side 4. The packing box is then closed and transported on its back side 4 to a location for display and distribution of the products from the packing box. The packing box 1 is put on its bottom side 5 as shown in FIG. 3. Subsequently, the top part above the tear lines 51*a*, 51*b*, 52*a*, 52*b* is removed by pulling the top part upwards and tearing along the tear lines 51*b*, 51*a*, 52*b*, 52*a*. This can be done using the handle opening 8 back side 4. A display case 1*a* of the packing box remains, which holds the articles on their bottom ends and their viewing sides towards the front side 3. The display case 1*a* with and without articles A is shown in FIGS. 4 and 6, respectively. The front side 3 presents a clean edge side 35.5 of the second flap 35 of the third (bottom) side panel 30, since edge side 35.5 has not been part of a tear line.

Figure 7:
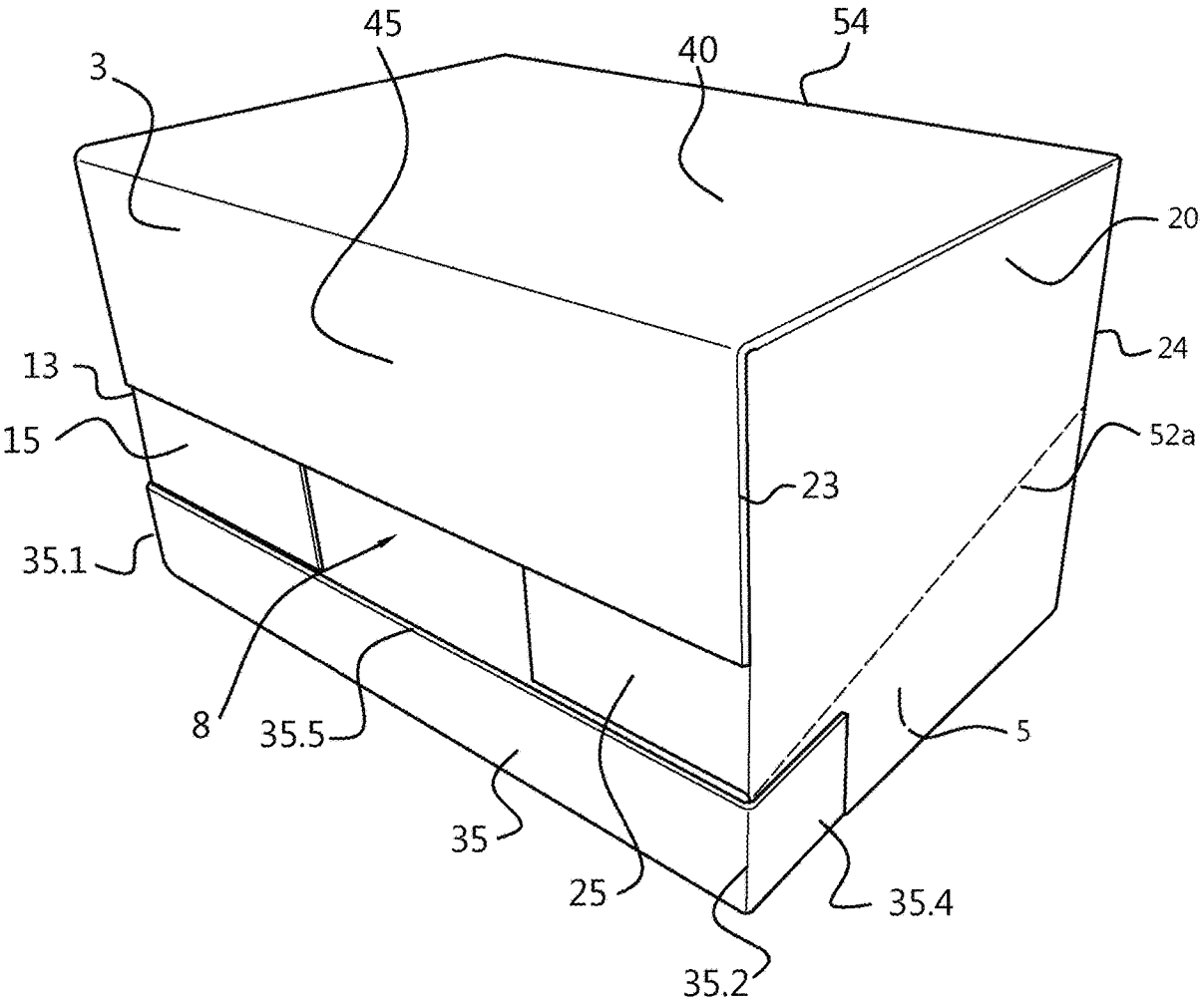
FIG. 7 shows a second embodiment of a packing box of the invention on its bottom side from the front side with closed front side.
Figure 8:
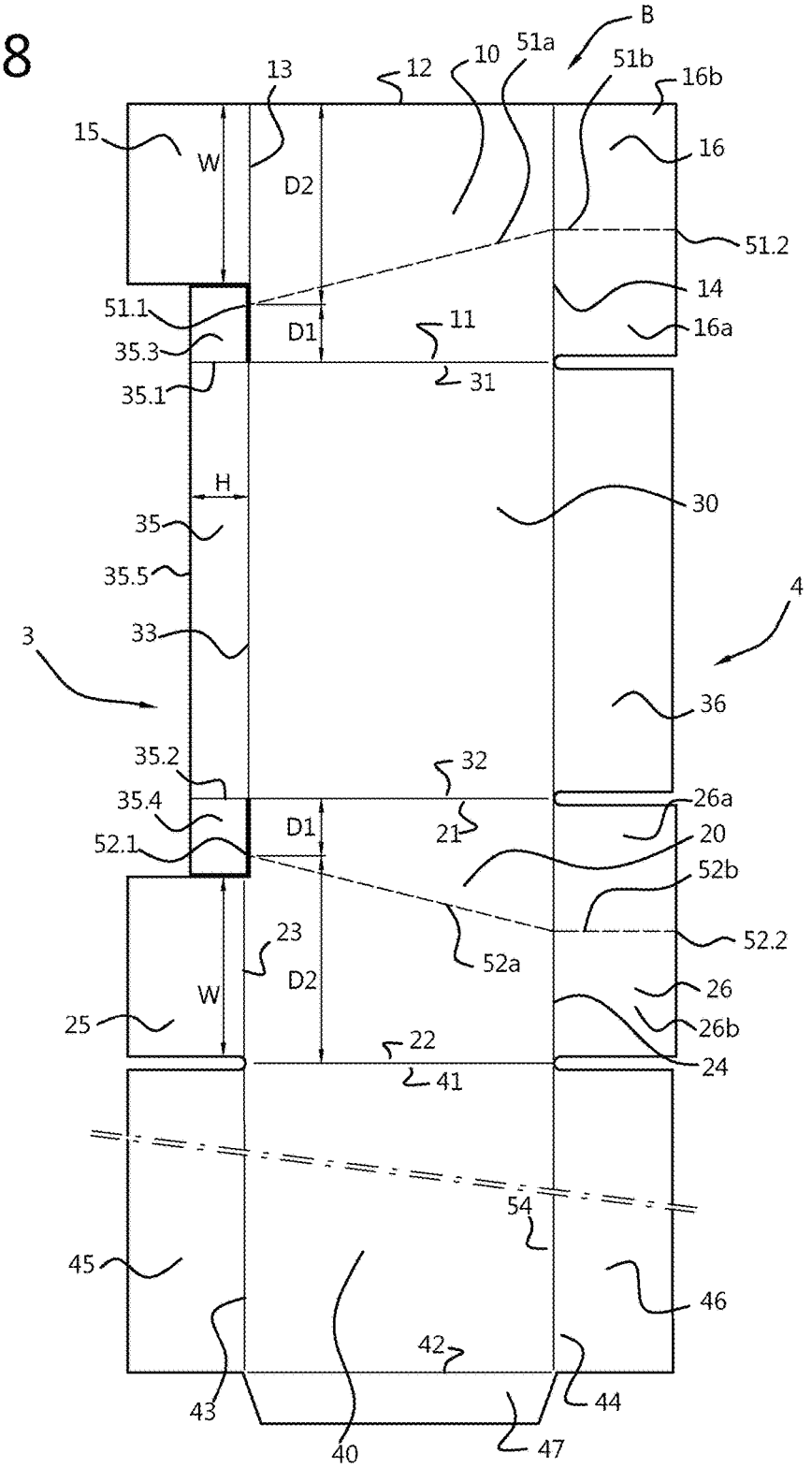
FIG. 8 shows a blank from which the packing box of FIG. 7 can be assembled.
Figure 9:
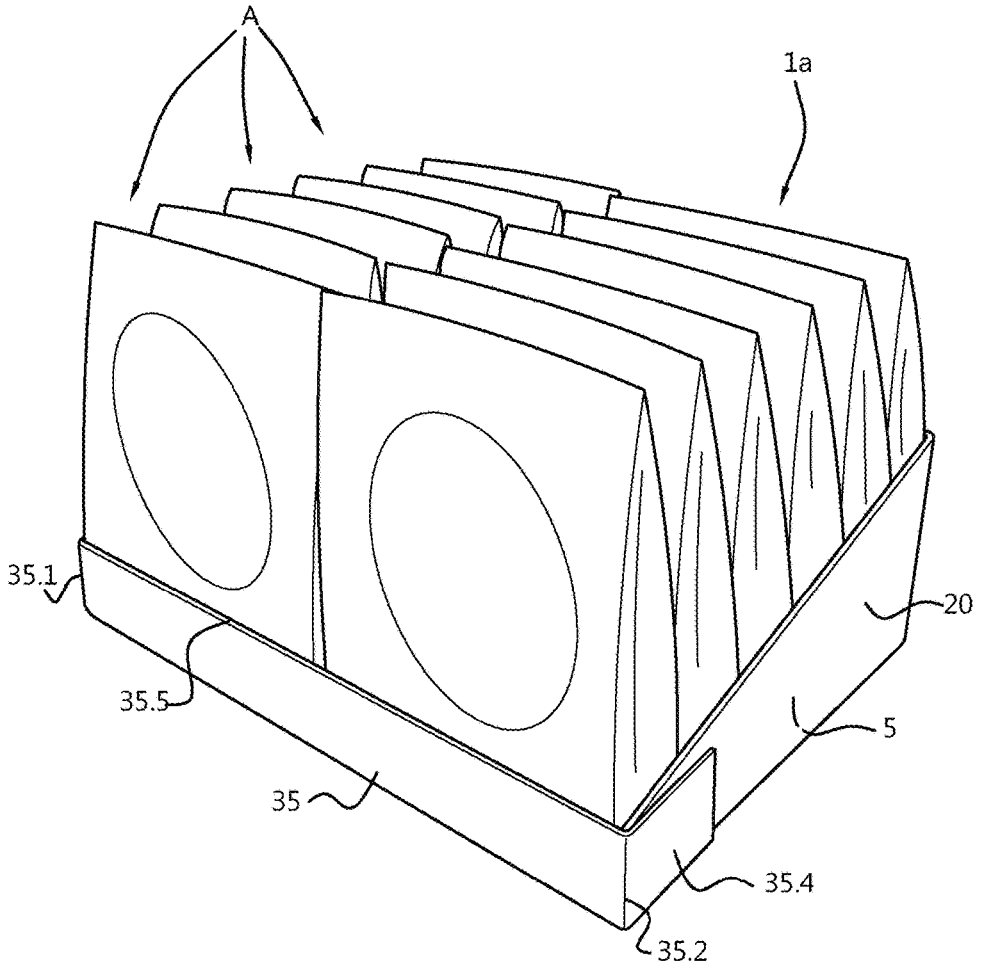
FIG. 9 show the display case part of the packing box of FIG. 7 filled with products.

FIGS. 7 to 9 show a second embodiment of the packing box 1 and corresponding blank B according to the invention. The second embodiment is largely identical to the first embodiment of FIGS. 1 to 6. The width of the third and fourth side panels 30, 40 of the second embodiment is larger than the width of the third and fourth side panels 30, 40 of the first embodiment. The second embodiment is suited to hold two rows of articles within the packing box and the associated display case part 1*a*, as specifically shown in FIG. 9.

The first flaps 15, 25, 35 of the first, second and fourth side panels 10, 20, 40 close the first end of the box, together with the first flap 35 of the third panel, in a slightly different manner in the embodiment shown. The first flaps 15, 25 of the first and second side panels are folded in first, after which the first flap 45 of the fourth side panel is folded in and attached to the first flaps 15, 25 of the first and second side panels using a glue. The first flaps 35, 45 of the third and fourth side panels 30, 40 are chosen to be in the same plane. In an alternative to the second embodiment, the first flaps 15, 25, 45 of the first, second and fourth side panels may be folded and attached as has been describe for the first embodiment, so having the first flap 45 of the fourth side folded in first. The heights of the first flaps 15, 25, 45 of the first, second and fourth side panels 10, 20, 40 are, relative to the dimensions of the first and second side panels, kept about the same as in the first embodiment. The first flaps 15, 25 of the first and second side panels 10, 20 together to not fully span the width of the third and fourth side panels across the first end of the packing box, and neither do the first flaps 35, 45 of the third and fourth side panels together span the width of the first and second side panels across the first end. This leaves an opening 8 between the first flaps in the closed position thereof, which opening serves as a handle opening 8 for grabbing the top part of the packing box, with reference to the position shown in FIG. 7, when separating the top part from the display case part 1*a*. The display case part 1*a* again presents a very clean edge side 35.5 of its front, that is of the first flap of the third side panel 30.

The packing box is generally filled with articles (products) on a filling line and transported on the filling line with a side panel with the shortest width facing the transporting direction, which corresponds to the first or second side panel in the embodiment of FIGS. 7 to 9.

Figure 2:
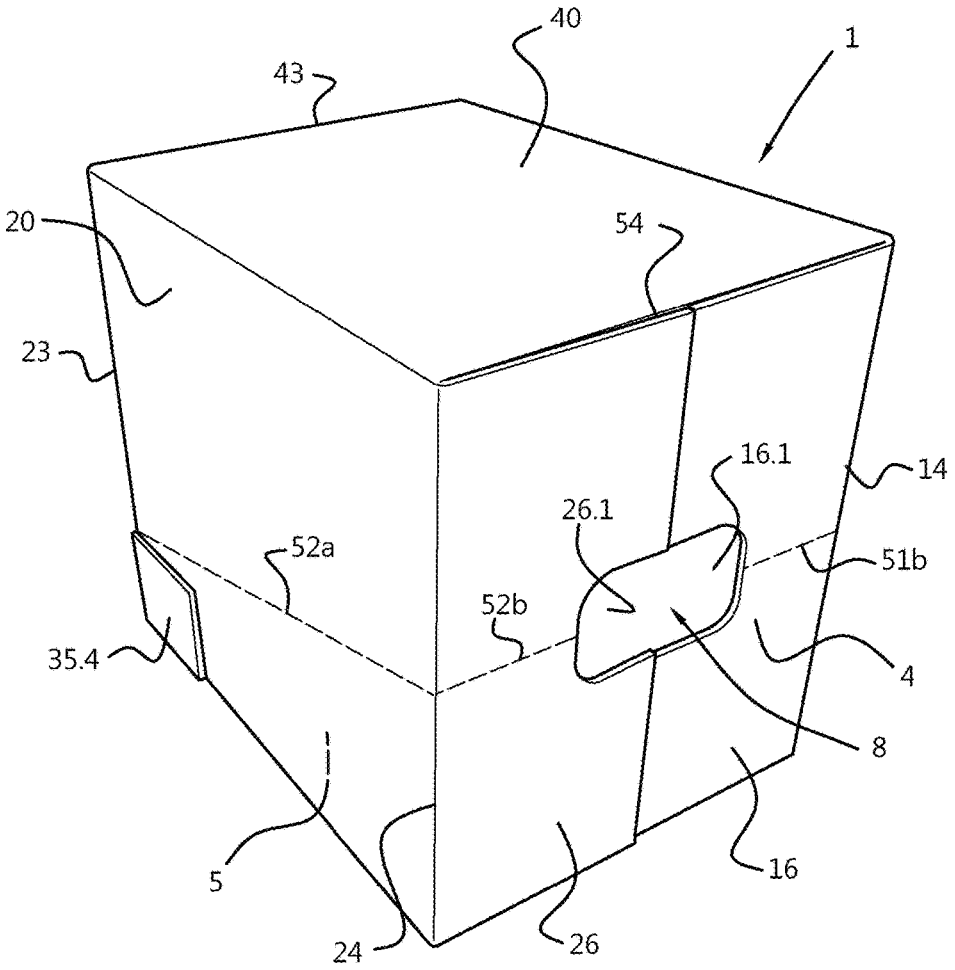
FIG. 2 shows the embodiment of FIG. 1 on its bottom side from the back side with closed front side.

The second flaps 16, 26 of the first and second side panels 10, 20 of the second embodiment do not have cutouts like the first embodiment as shown in FIG. 2 for providing a handle opening 8. The handle opening 8 of the second embodiment has been provided at the first side of the packing box. Alternatively, handle openings 8 can be provided at both the first and second ends of the packing box.

Figure 10:
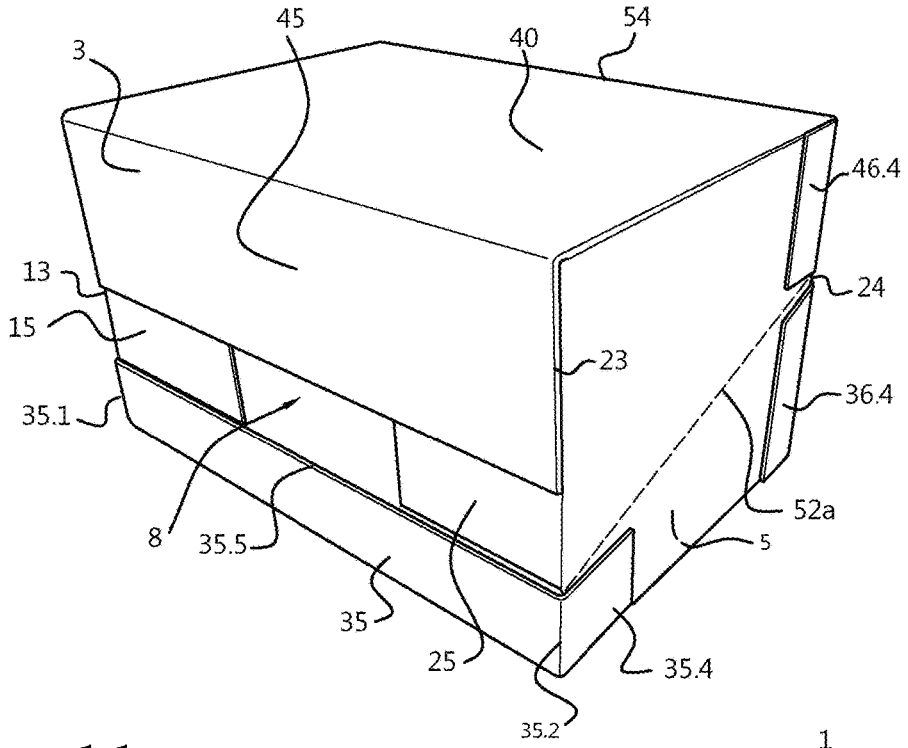
FIGS. 10 and 11 show an alternative of the second embodiment on its bottom side with closed front side from the front and back sides, respectively.
Figure 11:
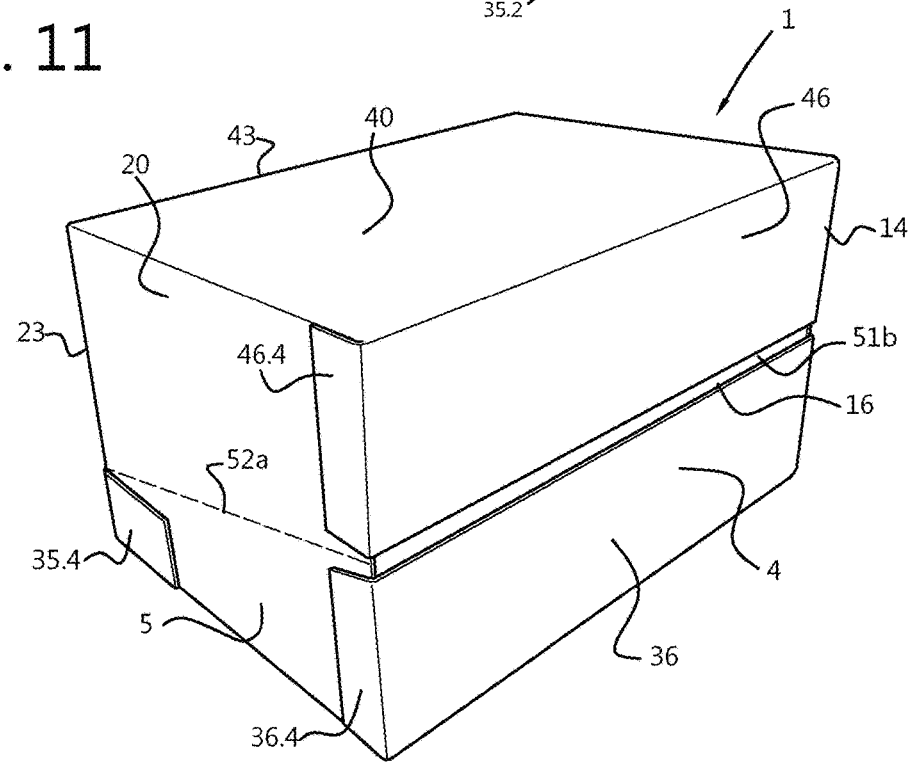
Figure 12:
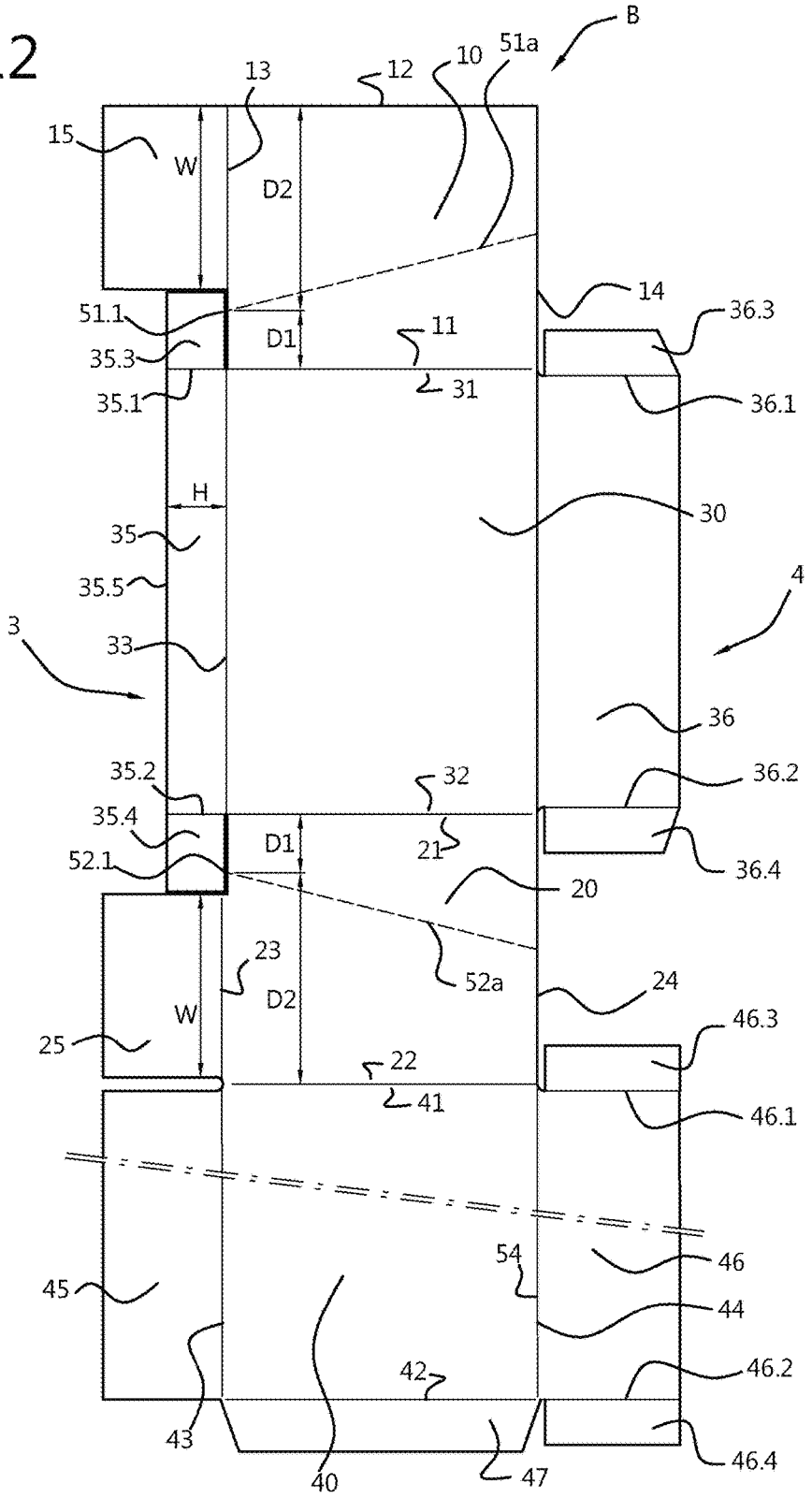
FIG. 12 shows a blank from which the packing box of FIGS. 10 and 11 can be assembled.

Another alternative to the second embodiment is shown in FIGS. 10 to 12. The alternative embodiment does not comprise second flaps of the first and second side panels 10, 20. The second end 4 of this embodiment is only closed by the second flaps 36, 46 of the third and fourth side panels 30, 40. To allow to do so these flaps have side skirts 36.3, 36.4, 46.3, 46.4 at their respective ends 36.1, 36.2, 46.1, 46.2 for attachment using a glue to respective side panels 10, 20. Other variations to the first and second flaps and closure of the first and second ends of the packing box are feasible as well.

The invention claimed is:

1. A packing box (1) for holding articles, the packing box comprising opposing first and second side panels (10, 20) and opposing third and fourth side panels (30, 40), each side panel having opposing first and second flank sides (11, 21, 31, 41, 12, 22, 32, 42) and opposing first and second end sides (13, 23, 33, 43, 14, 24, 34, 44), a flank side of one side panel being connected to a flank side of an adjacent side panel so as to determine a circumference of the packing box, the first and second side panels (10, 20) each with their first flank side (11, 21) being connected to a respective flank side (31, 32) of the third side panel (30), and the first and second side panels (10, 20) each with their second flank side (12, 22) being connected to a respective flank side (42, 41) of the fourth side panel (40), the first end sides (13, 23, 33, 43) of the first, second, third and fourth side panels corresponding to a first end (3) of the packing box and comprising first flaps (15, 25, 35, 45) that are configured for closing the first end of the packing box, and the second end sides (14, 24, 34, 44) of the first, second, third and fourth side panels corresponding to a second end (4) of the packing box and comprising second flaps (16, 26, 36, 46) that are configured for closing the second end of the packing box, wherein the first flap (35) of the third side panel (30) has opposing sides associated with the first and second side panels (10, 20), which opposing sides are or can be attached to the first and second side panels such that the first flap (35) of the third side panel partly closes the first end (3) of the packing box, and wherein tear lines (51.1, 52.1) are provided in at least the first and second side panels (10, 20) so as to allow removing a part of the first and second side panels (10, 20) and at least part of the fourth side panel (40) together with the first flaps (15, 25, 45) of the first, second and fourth side panels so as to leave a display case part (1*a*) of the packing box.

2. The packing box according to claim 1, wherein the display case part (1*a*) comprises the third side panel (30), the first flap (35) of the third side panel, parts of the first and second side panels (10, 20) connected to the third side panel, and at least parts of the second flaps connecting third side panel and the parts of the first and second side panels connected to the third side panel.

3. The packing box according to claim 1, wherein the tear lines (51*a*, 52*a*) in the first and second side panels (10, 20) have an end (51.1, 52.1) at the respective first end sides (13, 23) of the first and second side panels.

4. The packing box according to claim 3, wherein the first flap (35) of the third side panel (30) has a flap height (H) as measured from the first end side (33) of the third side panel to an opposing edge side (35.5) of that first flap (35), and wherein the end (51.1, 52.1) of the tear lines (51*a*, 52*a*) at the respective first end sides (13, 23) of the first and second side panels (10, 20) is at a distance (D1) from the respective first flank sides (11, 21) of the first and second side panels, which distance (D1) substantially corresponds to the flap height (H).

5. The packing box according to claim 4, wherein the first flaps (15, 25) of the first and second side panels (10, 20) are only connected to the first and second side panels, respectively, between the respective tear line (51*a*, 52*a*) and the respective second flank side (12, 22) of the first and second panels.

6. The packing box according to claim 4, wherein distance (D1) is equal to the flap height (H).

7. The packing box according to claim 3, wherein the tear lines (51*a*, 52*a*) in the first and second side panels (10, 20) extend to respective second end sides (14, 24) of the first and second side panels.

8. The packing box according to claim 7, wherein the tear lines (51*a*, 52*a*) in the first and second side panels (10, 20) extend into respective second flaps (16, 26) of the first and second side panels such that these second flaps each are divided into two parts (16*a*, 26*a*; 16*b*, 26*b*) associated with the third and fourth side panels (30, 40).

9. The packing box according to claim 8, wherein, in a configuration wherein the second flaps (16, 26, 36, 46) close the second end (4) of the packing box, the second flap (36) of the third side panel (30) is only attached to the parts (16*a*, 26*a*) of the second flaps (16, 26) of the first and second side panel (10, 20), which are associated with the third side panel (30), and the second flap (46) of the fourth side panel (40) is only attached to the parts (16*b*, 26*b*) of the second flaps (16, 26) of the first and second side panel (10, 20), which are associated with the fourth side panel (40).

10. The packing box according to claim 9, wherein the respective second flaps are attached by a glue.

11. The packing box according to claim 8, wherein, in a configuration wherein the second flaps (16, 26, 36, 46) close the second end (4) of the packing box, the second flaps (36, 46) of the third and fourth side panel (30, 40) do not overlap, and the tear lines (51*b*, 52*b*) in the second flaps (16, 26) of the first and second side panels (10, 20) are intermediate of the second flaps (36, 46) of the third and fourth side panels (30, 40).

12. The packing box according to claim 8, wherein the second flaps (16, 26) of the first and second side panels (10, 20) comprise cutouts (16.1, 26.1) in their respective sides opposing the second end sides (14, 24) of the respective first and second side panels (10, 20), and an end (51.2, 52.2) of the tear lines (51*b*, 52*b*) is provided at the respective cutouts, which cutouts provide a handle opening (8) in the second end (4) of the packing box in a configuration wherein the second flaps (16, 26, 36, 46) close the second end of the packing box.

13. The packing box according to claim 12, wherein the second flaps (36, 46) of the third and fourth side panel (30, 40) are configured such that they do not overlap with the handle opening (8) in a configuration wherein the second flaps (16, 26, 36, 46) close the second end of the packing box.

14. The packing box according to claim 7, wherein the tear lines (51*a*, 52*a*) in the first and second side panels (10, 20) do not pass or extend to and/or along a flank side (11, 12, 21, 22).

15. The packing box according to claim 1, wherein the first flap (35) of the third side panel (30) has a side skirt (35.3, 35.4) at each of its opposing sides (35.1, 35.2) associated with the first and second side panels (10, 20), the side skirts being configured to allow attaching of the side skirts to the respective first and second side panels such that the first flap (35) of the third side panel partly closes the first end (3) of the packing box.

16. The packing box according to claim 1, wherein the first flaps (15, 25) of the first and second side panels (10, 20) have a flap width (W) as measured along the respective first end sides (13, 23) of the first and second side panels, which flap width (W) is equal to or smaller than a distance (D2) along the respective first end sides of the first and second side panels between the respective second flank sides (13, 23) and the end (51.1, 52.1) of the respective tear lines (51*a*, 52*a*) at the first end sides (13, 23) of the first and second side panels, and wherein the first flaps (15, 25) of the first and second side panels are connected to the respective first end sides (13, 23) between the respective second flank sides (12, 22) and the end of the respective tear lines at the first end sides of the first and second side panels.

17. The packing box according to claim 16, wherein the flap width (W) of the first flaps (15, 25) of the first and second side panels (10, 20) is such that these first flaps and the first flap (35) of the third side panel (30) do not overlap in a configuration wherein the first flaps (15, 25, 35, 45) close the first end (3) of the packing box.

18. Blank for providing a packing box according to claim 1, wherein the blank (B) comprises first, second, third and fourth side panels (10, 20, 30, 40), each side panel having opposing first and second flank sides (11, 21, 31, 41, 12, 22, 32, 42) and opposing first and second end sides (13, 23, 33, 43, 14, 24, 34, 44), a flank side of one side panel being connected to a flank side of an adjacent side panel, the first and second side panels each with their first flank side being connected to a respective flank side of the third side panel, the fourth side panel with one of its first and second flank sides being connected to a flank side of one of the first and second side panels, which flank side of the one of the first and second side panels is not connected to the third side panel, the first end sides of the first, second, third and fourth side panels corresponding to a first end (3) of the blank and corresponding packing box and comprising first flaps that are configured for closing the first end of the packing box, when assembled, and the second end sides of the first, second, third and fourth side panels corresponding to a second end (4) of the blank and corresponding packing box and comprising second flaps that are configured for closing the second end of the packing box, when assembled, wherein the first flap of the third side panel has opposing sides associated with the first and second side panels, which opposing sides can be attached to the first and second side panels such that the first flap of the third side panel partly closes the first end of the packing box, when assembled, and wherein tear lines are provided in at least the first and second side panels so as to allow removing a part of the first and second side panels (10, 20) and at least part of the fourth side panel (40) together with the first flaps of the first, second and fourth side panels.

19. The blank according to claim 18, wherein the other one of the first and second flank sides of the fourth side panel comprises a side skirt configured for attachment to a flank side of the other one of the first and second side panels, which flank side of the other one of the first and second side panels is not connected to the third side panel.

20. The blank according to claim 18, wherein the blank is made from a single piece of material.

* * * * *